US008274045B2

(12) United States Patent
Bamberger et al.

(10) Patent No.: US 8,274,045 B2
(45) Date of Patent: Sep. 25, 2012

(54) IMAGING MASS SPECTROMETRY PRINCIPLE AND ITS APPLICATION IN A DEVICE

(76) Inventors: Casimir Bamberger, Freiburg (DE); Andreas Bamberger, Freiburg (DE)

( * ) Notice: Subject to any disclaimer, the term of this patent is extended or adjusted under 35 U.S.C. 154(b) by 297 days.

(21) Appl. No.: 12/424,817

(22) Filed: Apr. 16, 2009

(65) Prior Publication Data

US 2009/0261243 A1 Oct. 22, 2009

(30) Foreign Application Priority Data

Apr. 16, 2008 (EP) ..... 08154620

(51) Int. Cl.
*H01J 49/40* (2006.01)

(52) U.S. Cl. ..... 250/287; 250/281; 250/282

(58) Field of Classification Search ..... 250/287, 250/294, 296, 306, 307
See application file for complete search history.

(56) References Cited

U.S. PATENT DOCUMENTS

| | | | | |
|---|---|---|---|---|
| 5,128,543 | A * | 7/1992 | Reed et al. | 250/287 |
| 5,349,185 | A * | 9/1994 | Mendenhall | 250/287 |
| 5,641,919 | A * | 6/1997 | Dahneke | 73/865.5 |
| 6,037,586 | A * | 3/2000 | Baril | 250/287 |
| 6,833,545 | B2 * | 12/2004 | Axelsson | 250/297 |
| 7,084,393 | B2 | 8/2006 | Fuhrer et al. | |
| 7,485,873 | B2 * | 2/2009 | Ward et al. | 250/423 F |
| 7,554,096 | B2 * | 6/2009 | Ward et al. | 250/423 F |
| 7,554,097 | B2 * | 6/2009 | Ward et al. | 250/423 F |
| 7,786,452 | B2 * | 8/2010 | Ward et al. | 250/423 F |

FOREIGN PATENT DOCUMENTS

| | | |
|---|---|---|
| EP | 1278246 A1 | 1/2003 |
| JP | 2006 078470 | 3/2006 |
| JP | 2007 157353 | 6/2007 |

OTHER PUBLICATIONS

European Search Report; EP 08 15 4620; Jan. 15, 2009.

X. Llopart, "Timepix, a 65k programmable pixel readout chip for arrival time, energy and/or photon counting measurements", Nuclear Instruments and Methods in Physics Research A, 581 (2007) 485-494.

F. Sauli, "Principles of Operation of Multiwire Proportional and Drift Chambers", CERN European Organization for Nuclear Research, Lectures given in the Academic Training Programme of CERN, 1975-1976, Geneva 1977.

V.M. Blanco Carballo et al. "Charge amplitude distribution of the Gossip gaseous pixel detector", Nuclear Instruments and Methods in Physics Research, 2007, Section A, vol. 583, pp. 42-48, XP022350548.

(Continued)

*Primary Examiner* — Nikita Wells
*Assistant Examiner* — Johnnie L Smith
(74) *Attorney, Agent, or Firm* — Cantor Colburn LLP

(57) ABSTRACT

A method of imaging mass spectroscopy and a corresponding apparatus are provided, wherein the m/z-ratio of ions as well as the location of said ions on a sample surface are detected simultaneously in a time of flight mass spectrometer. The detector is a semiconductor array detector comprising pixels, that each can be arranged to measure a signal intensity of a signal induced by the ions or their time of arrival. A four-dimensional image consisting of the two lateral dimensions on the sample surface, the m/z-ratio representing the ion type and the abundance of an ion type on the surface can be reconstructed from repeated measurements for which a correspondingly adapted computer program product can be involved.

19 Claims, 11 Drawing Sheets

OTHER PUBLICATIONS

Hamamatsu Photonics, "High Time Resolution TOF-MS Detector High Voltage Floating Operation", MCP Assembly, May 2007, pp. 1-2, www.hamamatsu.com, Iwata City, Japan.

X. Llopart et al. "Timepix, a 65k quantum imager readout chip for arrival time, energy and/or event counting measurements", Nucl. Instr. Meth. A, 2007, pp. 102-105, Switzerland.

Stefan I. Luxembourg, et al. "High-Spatial Resolution Mass Spectrometric Imaging of Peptide and Protein Distributions on a Surface", Analytical Chemistry, Sep. 2004, pp. 5339-5344, vol. 76, No. 18.

Liam A. McDonnell et al. "Imaging Mass Spectrometry", FOM Institute for Atomic and Molecular Physics, Wiley InterScience, Apr. 2007, pp. 606-643, vol. 26, The Netherlands, www.interscience.wiley.com.

Vallerga et al. "High-resolution UV, Alpha and Neutron Imaging with the Timepix CMOS readout" 9th International Workshop on Radiation Imaging Detectors, Jul. 2007, Erlangen.

* cited by examiner

A

B

C

A

B

A

Fe+

B

A

B

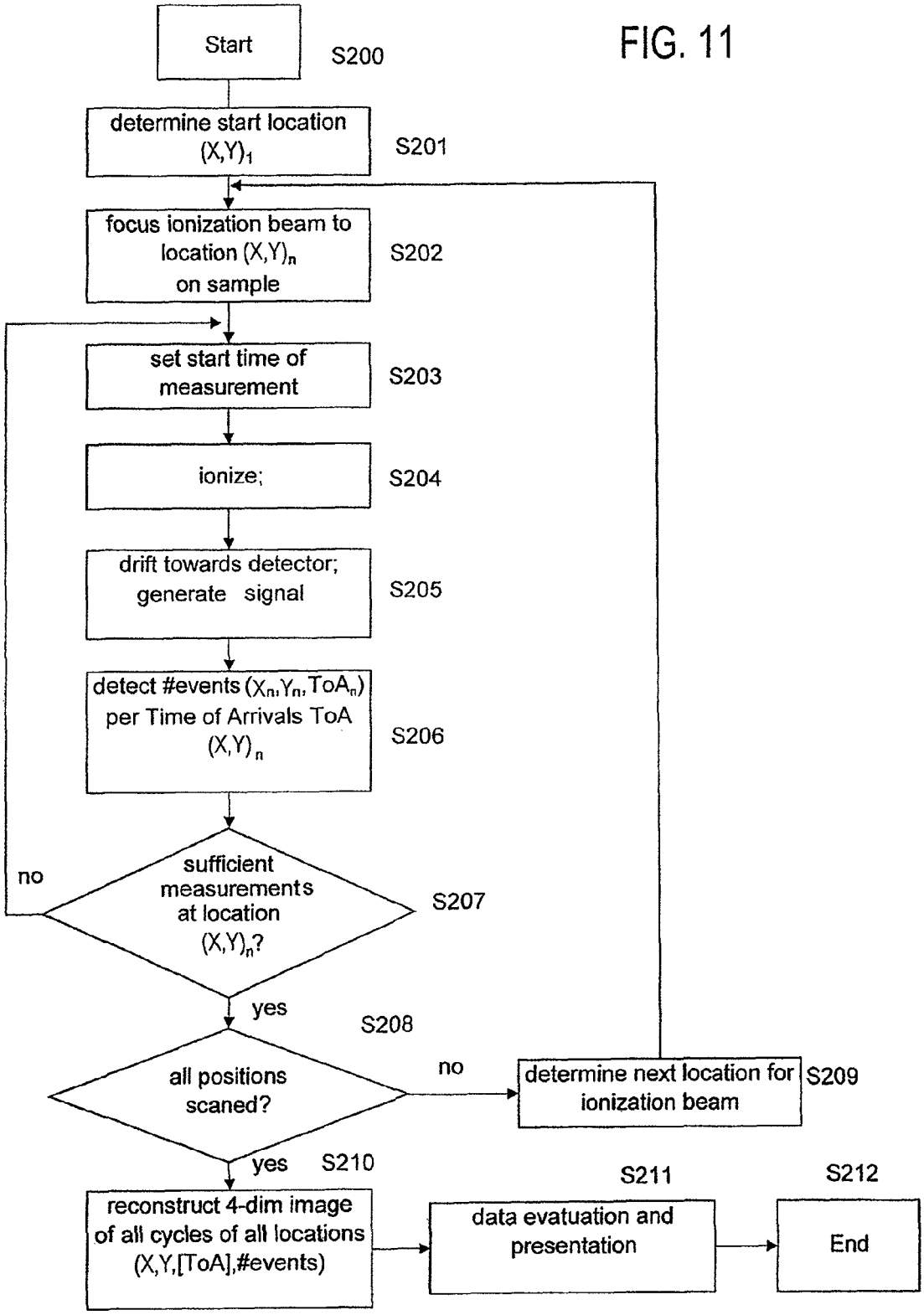
FIG. 11
Start
S200
determine start location $(X,Y)_1$
S201
focus ionization beam to location $(X,Y)_n$ on sample
S202
set start time of measurement
S203
ionize;
S204
drift towards detector; generate signal
S205
detect #events $(X_n,Y_n,ToA_n)$ per Time of Arrivals ToA $(X,Y)_n$
S206
sufficient measurements at location $(X,Y)_n$?
S207
no
yes
S208
all positions scaned?
no
determine next location for ionization beam
S209
yes
S210
reconstruct 4-dim image of all cycles of all locations (X,Y,[ToA],#events)
S211
data evatuation and presentation
S212
End

IMAGING MASS SPECTROMETRY PRINCIPLE AND ITS APPLICATION IN A DEVICE

FIELD OF THE INVENTION

The present invention relates to imaging mass spectroscopy and more particular to a method, an apparatus and a computer product program for mass spectroscopy by a time of flight principle.

BACKGROUND OF THE INVENTION

In general, mass spectrometry allows the identification and quantification of atoms and molecules (hereinafter: "molecules") that can be ionized. Mass spectrometry is commonly used to characterize the molecular composition of a surface. It is a powerful method to detect, identify, and quantify molecules of different masses. Additional spectra obtained after fragmentation of a molecule can be performed for unambiguous identification of most molecules.

For certain applications like the characterization of surfaces in material sciences or the diagnostics of diseases like cancer, an image with a spatial resolution of the mass spectrum is required.

There are several different methods known to generate a maximum number of ions during each measurement cycle, a prerequisite for fast image acquisition:

For matrix assisted LASER desorption ionization (MALDI) (see: A. F. Maarten Altenaar, PhD-thesis, University Utrecht, Netherlands, 2007), a LASER beam is focused on one spot of the surface analyzed. In most cases, a matrix consisting of an organic compound with high light absorption embeds the molecules to be investigated. A focused laser beam ionizes a small portion of the surface area and a large number of ions are generated by a charge transfer from the ionized matrix to the bio-molecules. The exact mass for each of the resulting ionized molecules is determined by mass spectrometry in a subsequent step, typically in a time of flight mass analyzer. The lateral resolution achieved today comprises about 5 to 10 μm reflecting the maximal focussing of the LASER beam. In rare cases, a resolution of 1 μm can be achieved.

Other methods include fast atom bombardment (FAB). FAB destructively induces the ionization at the point to which the ion beam is focused on the surface. The ion gun generates a fast ion beam that consists for example of $In^+$ or $Ga^+$ ions. As soon as the accelerated ions impact on the target surface, a multitude of small, ionized fragments are generated from the bio-molecules present at this spot. Although FAB massively decomposes the surface of the sample, the ion beam can be focussed to a spot of less than 1 μm in diameter. One of the disadvantages of this technique relates to the strong impact of the ions on the surface which causes a substantial fragmentation of molecules, especially bio-molecules. A variation of FAB employs a liquid metal ion source. For example Bismuth ions can be used as ionization source.

Alternatively, the surface can be bombarded with Fullerenes (C60) that dissipate the kinetic energy upon impact on the surface and therefore lead to a softer ionization. Thus, less fragmentation of the ions generated is caused and therefore larger molecules may be ionized. This technique can be utilized to generate ions from a sub-micrometer spot on a sample.

Subsequently the ionized molecules are separated according to their specific m/z value. Here, m designates the mass and z designates the electric charge of the ion. The standard mass analyzers use either the time of flight (TOF) or quadrupole (Q) mass selection principle. Alternatively, ions may be trapped in an ion trap and their mass determined when expelled from the ion trap during a frequency scan.

Also, ions may be introduced into a cyclotron and their mass is determined based on their resonance frequency in a frequency scan. The m/z value of a molecule is correlated to the resonance frequency and determined by a Fourier transformation of the frequency spectra measured. This non-destructive principle of mass determination, also referred to as Fourier Transformation-Ion Cyclotron Resonance (FT-ICR), provides very high mass accuracy.

The mass selection principles outlined above, or any homo- or hetero-mer combination of these methods, are conventionally known. For an un-ambiguous identification of a molecule, secondary ions are generated in a collision cell located between two mass selecting units. For example, in a TOF/TOF setup secondary ions are generated in a collision cell.

An already well-known technology to reconstruct mass spectrometric images of a two dimensional surface is based on a single spot analysis (scanning principle). The ionization is induced in a small region (hereinafter: "spot") on the sample surface. A typical spot size is typically around 10 μm to 100 μm in diameter. The ions generated in the spot are detected in a mass spectrometer, e.g. a standard time of flight mass spectrometer. This allows determining not only the exact mass but also the abundance of each specific ion within the spot.

The mass spectrometer acquires mass spectra of adjacent spots and thereby scans the surface. Following data acquisition, a four-dimensional map or "picture" is assembled in which the x- and y-axis reflect the imaged surface and the z-axis the mass spectrum. The fourth dimension represents the ion rate measured. An image reflecting the ion abundance distribution of one m/z value over the surface can then be easily visualized.

When mass spectrometric images are reconstructed based on the scanning principle, the mass spectrometer scans the surface along a predetermined path and with a defined step-width. Typically, the instrument acquires more than a hundred and up to one thousand spectra at each individual spot. First, the mass spectrum from each point on a surface is recorded separately. Based on this information, the mass spectrometric image is reconstructed from the acquired mass spectra of each individual spot by a point by point reconstruction. Because a high number of repeated measurements at one spot are necessary and the mass spectra are acquired in each spot individually, the process of data acquisition is very time-consuming. In a variation of it, the long data acquisition time is reduced. In this case, the mass spectrum is only acquired at pre-determined spots on the surface and later an extrapolation allows to determine a subset of area to which this particular spectrum might fit additionally.

In FIG. 11, a flow chart of a duty cycle according to the conventional method is shown. First, in step S200, the system is initialized. In step S201, a start location $(X,Y)_n$ with n=1 on the sample is determined, where the first measurement cycle is performed on. n designates the number of locations to be scanned. The ionization beam, e.g. the laser beam or an atom beam, is focused to the predetermined location, S202.

A start time of the measurement is set in S203, e.g. by detecting the laser pulse used for ionization. A spot of the sample at the predetermined location $(X,Y)_n$ is ionized by the ionization beam pulse in step S204. In step S205, the generated ions drift towards the detector and may generate an amplified signal that impinges the detector. In the detector, the number of events per Time of Arrival $ToA_n$ $(X,Y)_n$ is counted (step S206), where the Time of Arrival is measured relative to the start time. If enough measurements have not been performed for a predetermined location yet to obtain a sufficient statistics, it is decided in S207, to return to S203. Otherwise, it is checked in step 208, if all locations of interest of the sample were investigated. If this is not the case, a next location for an investigation is determined, S209, and the procedure returns to step S202.

If all locations have been scanned ("yes" in step S208), the measurement part of a duty cycle is finished and a 4-dimensional image may be reconstructed from all cycles of all locations (S210). For that, the data may be arranged in sets of substantially the same Time of Arrival [ToA], representing a certain m/z ratio, location $(X,Y)_n$, and the number of events. If the number of measurement cycles was different at different locations, the number of events at a location should be normalized to the number of cycles at this location. Finally, in step S211 the data may be evaluated and presented. The duty cycle is finished in S212.

In order to reconstruct an image of an extended surface with one of the above schematically described instruments, a scanning process is required. Moreover, determined through the principle of measurement (maximal number of ions per duty cycle), the duty cycles for each measurement are relatively long. Typically, the duty cycle for the determination of a full mass spectrum image requires the number of ionization shots needed to acquire a spectrum with a given number of detected ions multiplied by the number of spots investigated to reconstruct the mass spectrum image.

The mass spectrometers of e.g. the TRIFT series are another attempt to provide a spatially resolved mass spectroscopic image of a surface (A. F. Maarten Altenaar, PhD-thesis, University Utrecht, Netherlands, 2007). The mass spectrometer of the TRIFT series is described here as an example for a mass spectrometer which is used in quality control during semiconductor microcircuit production, or in the investigation of surfaces of biological samples as described in the publication mentioned above.

In such a spectrometer, a time of flight mass separator is used to acquire the two-dimensional image for a very narrow range of m/z values. The time of flight mass separator is constructed such that it provides directional and velocity focussing properties (double focussing), that enable the arrival of a focussed ion image for a selected m/z value at the detector. In this instrument setup three electrostatic field sectors (for example Matzuda plates) are arranged at a 90° angle to each other along the flight path of the ions providing double velocity focussing.

The TRIFT series of time of flight mass spectrometers can image a surface. It can be operated either in a stigmatic or in an astigmatic mode. In the stigmatic mode, the spatial relationship of the ions is preserved until arrival at the detector. A large amount of molecules are ionized on a restricted surface area either with an ion beam or a laser beam illuminating the surface. The ionized molecules are accelerated. One m/z target value (or a narrow m/z target range) is selected during the drift phase by two blankers included in the instrumentation that enable the selection of a narrow m/z window that is observed at the detector. The position sensitive detector records the spatial distribution of the ions within the selected mass range. In detail, after signal conversion and amplification through a microchannel plate, a phosphor imaging screen converts electrons to light that is detected by a CCD camera.

Whereas this instrument images a surface area with spatial resolution, it is limited in its capacity and speed by at least three factors:

First, the instrument is only capable of generating three-dimensional data and not four-dimensional datasets. For each measurement cycle, a narrow m/z range of interest has to be selected, for which a mass spectrometric image is acquired. Therefore, all ions of different m/z values than the selected window are lost during each duty cycle. Typically, the duty cycle for the determination of a full mass spectrum image requires the number of ionization shots needed to acquire a spectrum with a given number of detected ions multiplied by the number of m/z ranges investigated to reconstruct the mass spectrum image.

Second, the ion signal is converted in an electron signal which induces a light signal at a phosphor-screen which is finally detected by a CCD camera. Although this is a standard procedure for acquiring images of signals converted to a light pulse, it restricts the efficiency of image acquisition by this three step conversion.

Third, the image acquisition requires several milliseconds due to the method used to record the light signal. The read out process of the CCD camera takes much more time than the duty cycle of the whole instrument. The long duty cycle is due to the photo sensor array used in CCD cameras which finally restricts the rate of image acquisition because sample ionization and mass separation within a time of flight mass spectrometer is achieved within microseconds.

In another attempt to imaging mass spectrometry a three layer delay-line anode was used (O. Jagutzki, V. Mergel, K. Ullmann-Pfleger, L. Spielberger, U. Spillmann, R. Dörner, H. Schmidt-Böcking: A broad-application microchannel-plate detector system for advanced particle or photon detection tasks: large area imaging, precise multi-hit timing information and high detection rate, Nucl. Instr. and Meth. in Phys. Res. A, 477 (2002) 244-249). It comprises three individual delay chains. From the relative delay of the signals arriving at the two ends of each delay chain, the position of a single event on that delay line can be obtained. With two independent delay lines, the determination of the location in a detection plane is not unambiguous, if two events occur at the same time at different locations. A third delay line allows for unambiguous identification even in this case of two simultaneous events but still the detector may suffer from ambiguities in the determination of an impact position at higher intensities.

SUMMARY OF THE INVENTION

Therefore it is an object of the present invention to overcome the drawbacks of the prior art.

According to aspects of the present invention a method of mass spectrometry determining at the same time the m/z value of a molecule is provided, where the m/z range is not restricted to a small m/z range, and the location of the molecule on the investigated surface is determined simultaneously, thus reducing significantly the time required for recording a mass spectroscopic image.

Such a method according to aspects of the present invention allows a rapid construction of images containing information about the molecular composition of two-dimensional surfaces. The method is comparable to that of a digital camera where the colours are replaced by the time of flight information representing the different types of ions.

According to a first aspect of the present invention, this object is solved by providing a method, setting a start time; extracting ions from a sample by an ionization pulse at a fixed time relative to the start time; accelerating said ions towards a signal generator located at a distance to the sample whereby the distribution of the ions on the sample is isomorphously imaged to the signal generator; generating from each ion, by the signal generator, a signal indicative of the position of the impingement of the ion onto the signal generator; detecting, by a detection element of a detector comprising two laterally separated detection elements, if a part of said signal with at least a pre-defined intensity is received by said detection element; and measuring, by at least one detection element of the detector, a time of arrival relative to the start time when said part of said signal with at least a pre-defined intensity is received by said detection element.

The method according to the first aspect can be a method of imaging mass spectroscopy.

According to the first aspect, the time of flight information of an ion and the position of the signal corresponding to a location of the ion on the sample can be obtained simultaneously, hence avoiding the need for any scanning. E.g., the position of the signal can be obtained by determining the center of gravity of detection elements detecting parts of the signal.

Preferably, this aspect of the invention comprises further measuring, by a detection element of the detector, the intensity of the received part of the signal.

Thus, the position of the signal on the detector can be obtained more precisely. E.g., the center of gravity of the detection elements detecting the signal can be determined from the positions of these detection elements weighted with the measured intensity.

Preferably, this aspect of the invention comprises further performing the ionization by irradiation with a laser beam or with an ion beam that illuminates or impinges on the sample area homogenously.

Thus the ionization can be adapted to the area under investigation and the type of ions and the rate of ions does not depend on the orientation of the sample relative to the ionization means.

More preferably, this aspect of the invention comprises further setting the intensity of ionization to extract an average of ions per detecting element by one pulse without resulting in a signal saturation of the detection element.

In embodiments according to this more preferred aspect, the intensity may be sufficient to generate quickly a mass spectrometric image but not over-saturating the detector. Therefore, the abundance and distribution of ions can be easier determined.

Preferably, the isomorphous imaging of this aspect of the invention comprises further a diminishment or an enlargement.

A diminishment can be obtained by bundling ions from a large surface area, an enlargement would allow microscopic imaging of the sample surface.

Preferably the ion trajectories between the sample and the signal generator are straight, bend, in a closed loop, single or multiple time reflected before arrival to the signal generator.

E.g., the ion trajectories can follow closed loops or are bend to more than 90° change in direction and thereby reflected. More preferably, ions are reflected in a main axis symmetric assembly of two ion mirrors with one or more lenses between two ion mirrors.

Preferably, this aspect of the invention comprises further data processing methods during or after data acquisition that allow reconstructing the position of the signal from the positions of the detection elements detecting a part of the signal.

More preferably, the detector according to this aspect of the invention comprises at least two detection elements configurable to measure an intensity and the method comprises further data processing methods during or after data acquisition that allow reconstructing the position of the signal from the intensities of parts of the signal measured by the detection elements.

Preferably, the detector according to this aspect of the invention comprises at least two detection elements configurable to measure a time of arrival, the method comprises further data processing methods during or after data acquisition that allow reconstructing the time of arrival of the signal from the times detected at the detection elements.

According to these last aspects, the evaluation of the determination of the position and the time of arrival of the signal can be performed.

According to a second aspect of the present invention, there is provided an apparatus comprising a sample holder; time signal means for providing a signal pulse; ionization means configured to ionize atoms or molecules of a sample on the sample holder by an ionization pulse at a fixed time relative to the signal pulse; imaging means configured to extract the ions from the sample and to accelerate them towards a generation means, whereby the distribution of the ions on the sample is isomorphously imaged to the generation means, the generation means being configured to generate a signal from an impinging ion indicative of the position of the impingement of the ion onto the signal generator; detector comprising two laterally separated detection elements configurable to detect if a part of said signal with at least a predefined intensity is received by said detection element; wherein at least one detection element is configurable to measure a time of arrival relative to the start time when said part of said signal with at least a pre-defined intensity is received by said detection element.

The apparatus according to the second aspect can be an apparatus for imaging mass spectroscopy.

More specifically, there is provided an apparatus comprising a sample holder; pulse generator for providing a signal pulse; a generator of an ionization configured to ionize atoms or molecules of a sample on the sample holder by an ionization pulse at a fixed time relative to the signal pulse; anode arrangement and imaging device configured to extract the ions from the sample and to accelerate them towards a signal generator, whereby the distribution of the ions on the sample is isomorphously imaged to the signal generator, the signal generator being configured to generate a signal from an impinging ion indicative of the position of the impingement of the ion onto the signal generator; detector comprising two laterally separated detection elements configurable to detect if a part of said signal with at least a predefined intensity is received by said detection element; wherein at least one detection element is configurable to measure a time of arrival relative to the start time when said part of said signal with at least a pre-defined intensity is received by said detection element.

According to the second aspect, such an apparatus is adapted to perform a method according to the first aspect of the invention.

Preferably, the detector of the second aspect of the invention comprises a detection element configured to measure an intensity of the received part of the signal.

More preferably, a detection element according to the second aspect of the invention is configurable to measure an intensity of the received part of the signal that is further configurable to measure the time of arrival of the received part of the same signal, or each detection element of a detector according to the second aspect of the invention is configurable to measure an intensity of said part of the signal and to measure the time of arrival of the received part of the same signal.

This last preferred aspect would allow for the highest spatial and time resolution possible with a given number of pixels per area.

Still preferably, the apparatus according to the second aspect of the invention comprises storage means configured to store the time of arrival of the part of the signal, the measured intensity of the received part of the signal and an identifier for each detection element as a data set; time reconstruction means configured for reconstructing the time of arrival of the signal from the stored times of arrival of the parts of the signal; and position reconstruction means configured for reconstructing the position of the impact of the signal from the measured intensities and the identifiers.

More specifically, the apparatus according to the second aspect of the invention comprises a detector and a memory configured to store the time of arrival of the part of the signal, the measured intensity of the received part of the signal and an identifier for each detection element as a data set; a time reconstructor configured for reconstructing the time of arrival of the signal from the stored times of arrival of the parts of the signal; and a position reconstructor configured for reconstructing the position of the impact of the signal from the measured intensities and the identifiers.

In embodiments according to these preferred aspects, the received intensity and time of arrival of parts of the signal may be used to determine the position and time of arrival of the signal more precisely than with other configurations of detection elements measuring a time and an intensity for an element.

Preferably, the detector according to the second aspect of the invention comprises a self-repetitive mosaic of detection elements spatially arranged in a repeating pattern such that detection elements configured to measure a time of arrival alternate according to a predefined rule with detection elements configured to measure an intensity.

E.g., the detector may comprise at least four detection elements arranged in an array of rows and columns and within each row detection elements configured to measure a time of arrival alternate with detection elements configured to measure an intensity; and within each column detection elements configured to measure a time of arrival alternate with detection elements configured to measure an intensity.

In embodiments according to this preferred aspect, a high spatial resolution of the measurement is combined with a high resolution of the elapsed time.

Preferably, the generation means according to the second aspect of the invention is a microchannel plate, the signal comprises electrons generated by the microchannel plate and the received intensity corresponds to the number of electrons impinging the detection element.

Preferably, the detector according to the second aspect of the invention is a semiconductor detector and the detection elements are pixel on the detector.

Still preferably, the apparatus according to the second aspect of the invention comprises at least two detectors, where the detectors are located adjacent to each other in the same plane, and where the pitch between adjacent detection elements on the same detector is substantially the same as the pitch between adjacent detection elements on adjacent detectors.

Thus, a detector system with a large area may be built. E.g. the pitch between adjacent detection elements on adjacent detectors may be not more than two to four times the pitch of adjacent detection elements on the same detector.

According to a third aspect of the invention, there is provided a computer program product embodied on a computer-readable medium, comprising program instructions which perform, when run on a computer, the execution of which result in operations of the data processing methods according to the first aspect of the invention.

Preferably, the computer program product according to the third aspect of the invention further comprises program instructions which perform, when run on a computer evaluating the number of signals with substantially the same lateral position and the same time of arrival when performing any of the data processing methods according to the first aspect of the invention and storing the evaluated number, the lateral position and the time of arrival in a set of data.

Other objects, features, and advantages of the present invention will become more apparent from the following detailed description of certain embodiments when read in conjunction with the accompanying drawings.

BRIEF DESCRIPTION OF THE DRAWINGS

FIG. 11 shows a flow chart according to a conventional method.

DETAILED DESCRIPTION OF CERTAIN EMBODIMENTS

Herein below, certain embodiments of the present invention are described in detail, wherein the features of the embodiments can be freely combined with each other unless otherwise described. However, it is to be expressly understood that the description of certain embodiments is given for by way of example only, and that it is by no way intended to be understood as limiting the invention to the disclosed details.

Figure 8:
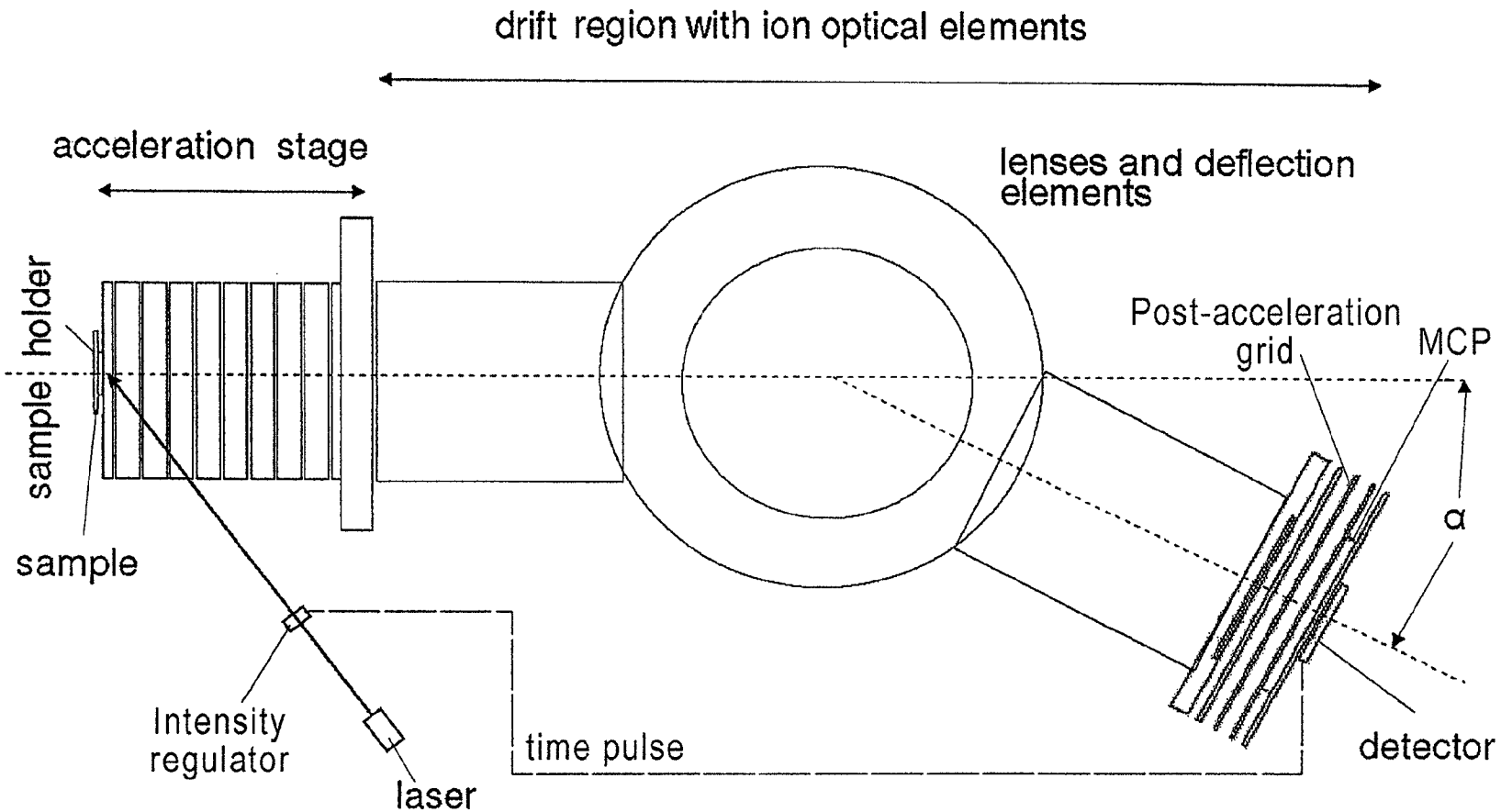
FIG. 8 shows an embodiment of the present invention in greater detail.

With respect to FIG. 8, first an overview of an imaging mass spectrometer according to certain embodiments of the present invention is given:

The imaging mass spectrometer as shown in FIG. 8 comprises three basic units: (1) An ionization chamber, (2) a time of flight mass separator, (3) and an array ion detector.

(1) The ionization chamber comprises a sample holder on an adjustable stage in order to position the sample. Ionization may be achieved by a pulsed LASER source of energetic photons of high flux that illuminates the extended surface of the specimen simultaneously. Depending on the molecules to be investigated, e.g. a $N_2$ laser may be used, but other laser types are applicable, too. The intensity of the laser beam is regulated in an intensity regulator that generates an electronic pulse to set a start time of a measurement.

(2) The ions are separated by a time of flight mass separator. There, the ions are accelerated by an electrical field. The obtained speed depends on the m/z ratio of the ions, where m designates the mass and z the charge of the ion. The ions enter a drift region, where ions of different m/z-ratios are separated in time because of their different speed. The ions are accelerated and drift in the drift region towards the microchannel plate MCP. The distribution of the ions on the sample is isomorphously imaged onto the MCP. This may be achieved e.g. by a pinhole in the drift space. Alternatively, one or several lenses may be included to increase the angular acceptance and to sharpen the image. Thus, within the apparatus, several different lenses and combinations of these in different orders may be included. The drift part may be straight or bended by applying appropriate lenses or deflection elements. The bending angle may be between 0° and 180° depending on the configuration of lenses and deflection elements.

Figure 1:
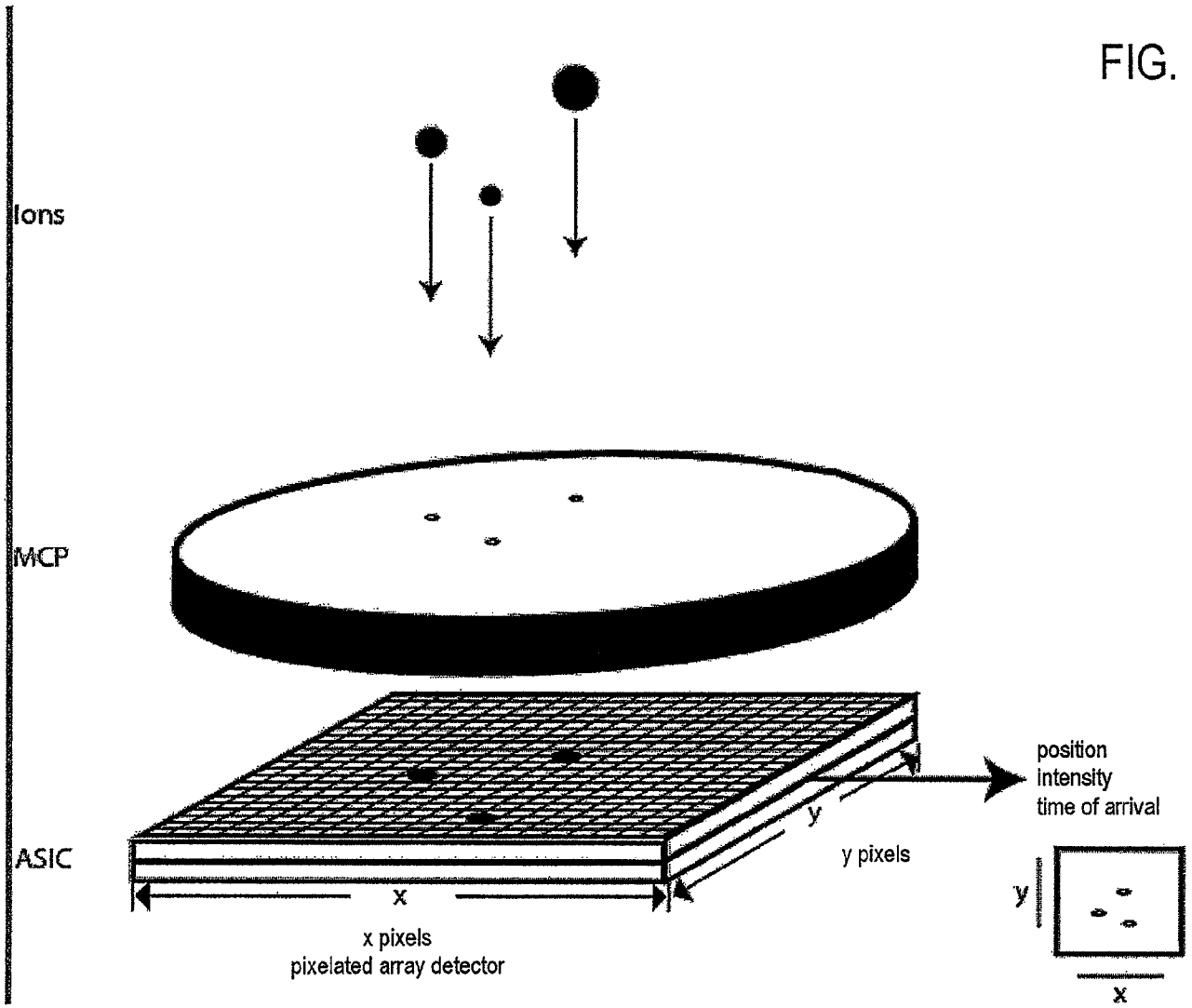
FIG. 1 shows a detail of a Time of Flight imaging mass spectrometer close to the detector according to the present invention.

(3) The detector used in the embodiment together with the MCP is shown in more detail in FIG. 1. In the MCP, an electron cloud is generated from each impinging ion. Its amplification is typically in the order of $10^3$-$10^7$. The electron cloud impinges the detector located closely behind the MCP. In an alternative embodiment, instead of the MCP e.g. a phosphor screen may be used. In this alternative embodiment, the detector detects the light emitted by the phosphor screen when an ion impinges the phosphor screen. One or more image intensifiers may be placed between the phosphor screen and the detector to amplify the light emitted.

The detector comprises an array of pixels and generates a two-dimensional picture for a range of m/z values, i.e. a range of times of arrival, and their intensities simultaneously. It localizes ions fast and precise in two dimensions with its detector surface comprising pixels. The detector may be tuned for different spatial amplifications of the original specimen, sometimes also referred to as enlargement factor. The detector allows resolving the localization of molecules within the range of one to several square micrometers. The detector according to the present embodiment determines the time of flight of ionized molecules per each pixel and each measuring cycle simultaneously. The full mass spectrum in one pixel is reconstructed after a series of repeated measurements.

According to certain embodiments of the present invention, the time needed for the image acquisition is dramatically reduced compared to conventional methods. With the detector for mass spectroscopy according to certain embodiments, it is faster to acquire the full m/z spectrum and the location of the ions on the sample surface at the same time than to scan the sample surface point-wise. The acquisition of the m/z values for a large region of an extended surface is achieved simultaneously. Therefore, the time needed for e.g. bio-molecule discovery or acquisition of a molecular fingerprint is reduced significantly by the usage of the described detector.

Since the Time of Flight is measured for each ion, the imaging mass spectrometer can cover a large range of different m/z values. E.g. in bio-medical applications, the time of flight mass analyzer allows to detect small molecules and metabolites as well as alterations in protein composition within a given tissue, cell or even sub-cellular compartment.

Figure 10:
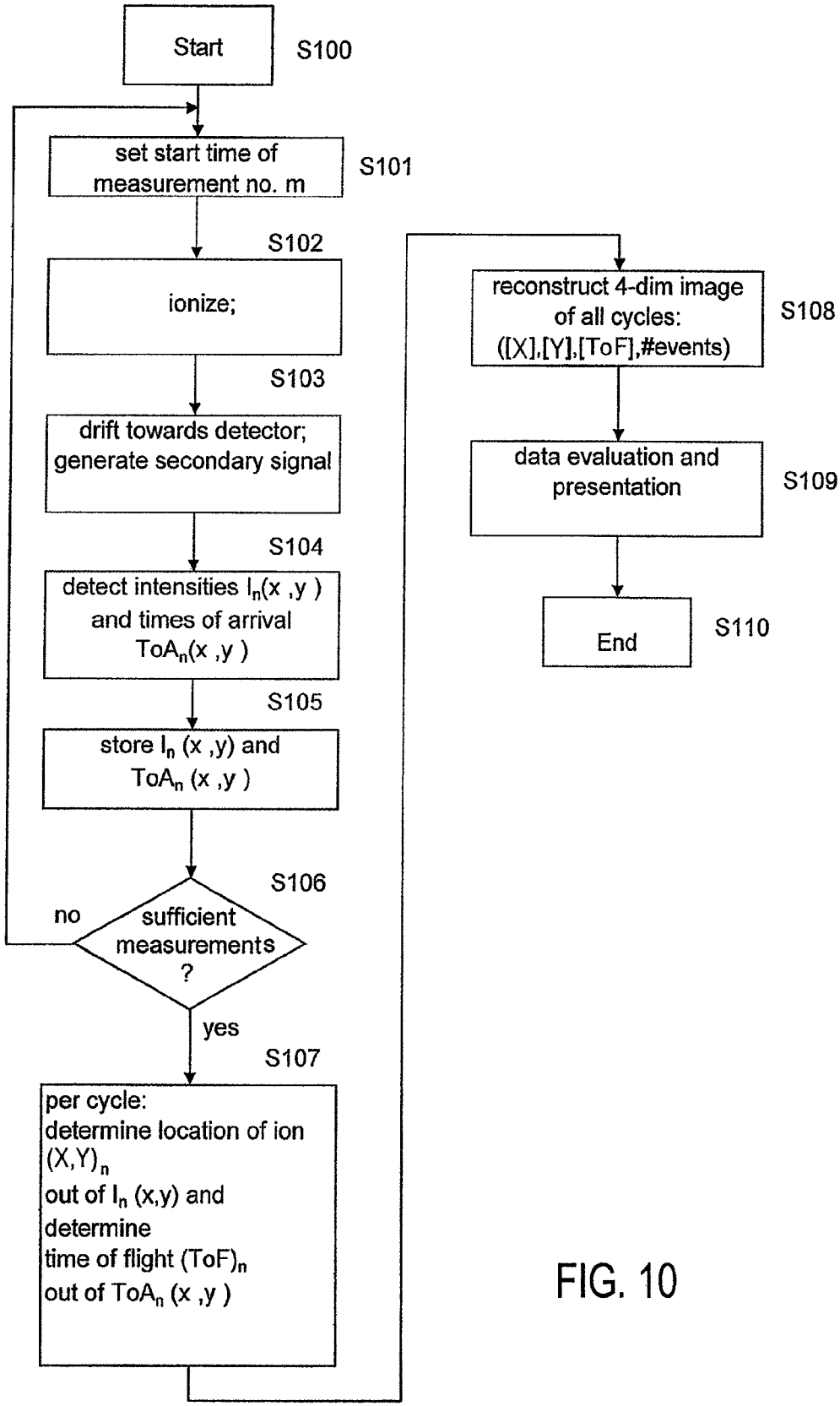
FIG. 10 shows a flow chart according to a method of the present invention.

In FIG. 10, a flow chart of a duty cycle according to an embodiment of a method according to the present invention is shown. First, in step S100, the system is initialized. A start time of the measurement cycle m is set in S101, e.g. by detecting the laser pulse used for ionization. An area of the sample is ionized by the ionization beam pulse in step S102. In step S103, the generated ions drift towards a signal amplifier, e.g. a microchannel plate generating an electron cloud. The signal (e.g. the electron cloud) impinges the detector.

In the detector, at pixel positions (x,y), the intensity of the signal $I_n(x,y)$ or its Time of Arrival $ToA_n(x,y)$ are detected, step S104. The Time of Arrival is measured relative to the start time. There may be pixels arranged to measure intensity and pixels arranged to measure a Time of Arrival. The values $I_n(x,y)$ and $ToA_n(x,y)$, respectively, are stored for each pixel (x,y), step 105. If enough measurements have not been performed yet to obtain a sufficient statistics, it is decided in S106, to return to S101. Otherwise, the measurement part of a duty cycle is finished.

In step S107, per measurement cycle n a position of one or several impinging electron clouds corresponding to an impingement position of an ion $(x',y')_n$ may be determined based on the intensities $I_n(x,y)$ and a Time of Flight $ToF_n$ out of the Times of Arrival $ToA_n(x,y)$. The relationship between the positions (x,y) on the detector and the locations (X,Y) on the sample and between Time of Flight and Time of Arrival may be predetermined by calibration experiments. Thus, the location of an ion on the sample may be determined from the intensities $I_n(x,y)$ on the detector. In step S108, a 4-dimensional image may be reconstructed from all cycles. For that, the data may be arranged in sets of substantially the same Time of Flight [ToF], representing a certain m/z ratio, substantially the same location ([X],[Y]) on the sample, and the number of events for this triplet. Finally, in step S109 the data may be evaluated and presented. The duty cycle is finished in silo.

In the following, the construction principle of an imaging mass spectrometer is described in detail including (1) a principle of surface ionization and ion ablation for (2) a time of flight detection with imaging capabilities, the principle of (3) ion detection and (4) image reconstruction, and its application to surface analysis techniques (5).

(1) The Ionization Principle

The kind of detector used according to certain embodiments of the present invention will influence the principle of the probe ionization process. In order to make use of the independent registration of ions produced at different spots on the sample surface, ionization over a large specimen area at the same time is achieved.

Molecules or atoms are ionized from a two-dimensional surface of interest at different spots at once. The ionization typically results in a few ions per pixel such that finally only one ion per pixel will be detected.

Certain embodiments of the present invention are applicable to a range of different molecules like bio-molecules including metabolites, proteins, lipids and single atoms. Either an ion beam or a LASER beam achieves the ionization of molecules accompanied by their transfer in the gaseous phase. In general, any technique that allows the ionization molecules to be present on an extended surface area is applicable. According to a certain embodiment of the present invention an ionization method is used that generates ions from a relatively large area of spots and not only from a single spot on the sample surface (e.g. only one molecule per ionization process and pixel).

Preferably, the ionization method deployed generates randomly ionized molecules of different m/z values from the molecules under investigation, e.g. bio-molecules. The summary of all ionized molecules detected subsequently reflects then a broad spectrum of molecules present on the sample surface. The ionization process according to certain embodiments is designed in such that it ionizes with almost no selectivity for a specific molecule under investigation and in contrast allows the ionization of any molecule. Any technique that ionizes molecules from a large area (μm to cm) with very low lateral diffusion of the ions subsequent to the ionization process may be used to achieve high spatial resolution. Advantages of the detection method according to certain embodiments are that (1) the ionization process is relatively non-selective with respect to the ionized molecule under investigation and (2) allows the generation of different m/z ions at several spots on the sample, and that (3) it generates only one ion or a small number during each ionization cycle (preferably not more than one ion per detector pixel) so that the detector is not saturated with incoming ion signals that would restrict the resolving capacity of the detector.

In order to achieve this ionization, a de-focused LASER beam may be used to illuminate the area of interest like in a typical NIMS experiment (Nanostructure Initiator Mass Spectrometry). As only one ion per detector pixel will be generated, a weak ionization procedure might be advantageous.

In certain embodiments, the ionization intensity is controlled by an intensity regulator in the path of the laser light. It may be used for generating a pulse for resetting the timers allocated to the pixels of the detector. Alternatively, e.g. a trigger signal for generation of the laser pulse or a signal of a light detector receiving light from the laser may be used.

The speed and success of the imaging mass spectrometer according to certain embodiments of the present invention is based on the fact that it is easier to achieve saturation in each mass spectrum and pixel of the detector than to scan the whole surface spot by spot as according to conventional scanning methods. E.g. for certain applications 50.000 to 100.000 individual ions of identical or different m/z values measured may be enough to generate a significant mass spectrum per pixel. Apparently, it is very efficient to measure a single ion per pixel at the same time across the area of interest. The sampling procedure may be stopped, once enough events for an m/z value are collected and the number of m/z values measured is diverse enough to provide enough information.

(2) The Time of Flight Section

According to certain embodiments of the invention it is possible to reconstruct correctly the location of the ions generated at the surface of a sample, e.g. a tissue section. The principle of the time of flight mass spectrometer of certain embodiments is the selection and focussing of the ion bundle in the time of flight sector of the instrument such that it maps the ions generated at the surface of the sample on the detector surface only with minimal two dimensional distortion (e.g. caused by a low transversal momentum component).

In certain embodiments, the drift part of the imaging mass spectrometer is constructed in such that it corrects during the time of flight for m/z molecules with different initial kinetic energies. The drift element may let pass ions of a broad mass range and corrects for their spatial distortion resulting from the different initial kinetic energies acquired by the ions during the ionization process. For that purpose, a simple pinhole, electrostatic lenses or electrostatic field sectors may be used. This may also be done by the known method of delayed extraction, by use of a reflectron or in a switched time of flight mass spectrometer.

In some applications it might be necessary to select for a specific m/z range. In certain embodiments a narrow m/z distribution of ions may be selected to let pass. E.g. in case multiple ions are generated at the same spot of the pixel but of different m/z value, ions of a certain m/z window may be selected or ions with an unwanted m/z may be excluded with blankers. As another example, the strong ionization of the matrix due to the MALDI approach produces a number of low mass ions that also enter the mass spectrometer and may arrive earlier than the signal of interest. In addition, such a restriction of the m/z range allows optimal focussing for the distortion correction within the drift part of the time of flight tube of the instrument.

Therefore, the imaging TOF instrumentation can also implement for example two electrostatic field shutters that allow a restriction of the m/z range analyzed to a specific, narrow bandwidth of m/z values. Additional electrostatic focussing ion lenses may be included. These focussing lenses may also be used to magnify the area of interest on the surface of the sample in order to allow a detailed image, for example a sub-cellular analysis of a tissue sample. In contrast to the conventional scanning principle for image reconstruction, certain embodiments of the present invention employ electrostatic lenses in order to visualize the surface of interest with stigmatic lenses.

(3) The Detector Principle

The ions leaving the drift field of the mass spectrometer are post-accelerated by an electrostatic field, before hitting the surface of a microchannel plate (MCP). When hitting the MCP, post-amplified ions liberate one or multiple electrons that are multiplied in individual channels of the MCP. Typical signal amplifications achieved are in the magnitude of $10^3$ to $10^7$.

This amplified electron cloud is detected by an application specific integrated circuit (ASIC) semiconductor array chip positioned behind the microchannel plate. Typically, the electron cloud generated at the MCP hits several pixels of the chip.

The detector set up of certain embodiments allows recording the separation of ionized molecules according to their time of flight. In certain embodiments one or several ions per each cycle and pixel are detected. The time of arrival of electrons generated from a single ion or multiple ions is registered by specifically configured pixels on the detector surface. The time of arrival is measured relative to the reset pulse generated by the intensity regulator at the time of the laser beam, as outlined above.

In certain embodiments, the "TIMEPIX" detector of the MEDIPIX collaboration can be used (see Xavier Llopart Cudié, PhD thesis, Mid Sweden University, Sundsval, Sweden, 2007). Each pixel of the array chip may be operated in one of three modes, i.e. arrival time, time over threshold and event counting. In a so-called "mixed mode", it is possible to configure some of the pixels to measure the time of arrival while other pixels measure simultaneously the intensity of the signal. The differently configured pixels may be located adjacent to each other, such that a good spatial resolution of the signal may be obtained.

The semiconductor chip array detector "TIMEPIX" is a highly integrated monolithic device (ASIC) of few square centimeters in size (array detector), typically between 1 $cm^2$ to 6 $cm^2$. Every detector pixel is of square size comprising a lateral length between 10 to 70 μm. The pixel sensitivity is extremely high and works noise free due to an individual pixel calibration. Each pixel has a front-end digitisation with respect to the time measurement. The time stamp recorded is stored in an individual register for each pixel. The accuracy of the spatial position is in the order of one to several micrometers depending of the pixel size and the accuracy of the time measuring clock. Typically, the precision of the clock is in the range of few nanoseconds using a special reconstruction code in a software program. The fast recording speed is accomplished by the data taking method. Each register associated with one pixel is read out in parallel in a fraction of a millisecond.

The semiconductor detector chips which can be used for certain embodiments of the present invention can either be used in a stand alone version or assembled to large detector areas. Thereby, larger detection surfaces without distortion or disruption are achieved. The acquisition of mass spectra can be further improved with a multi-hit capability per each pixel.

The high sensitivity and dynamic range provided by the ASIC array detector used in certain embodiments can be advantageous for the field of mass spectrometry.

The ASIC detector set up allows registering the arrival time of an event which thereby determines the m/z ratio of a detected ion. According to certain embodiments, the detector chip is connected to an external clock. Alternatively, a clock could also be integrated with the chip or may be provided for each pixel separately. The precise determination of the arrival time is done based on the electron-induced signal intensity. The finite rise time of the circuit may cause a small time shift. Therefore the array detector may be used in a checkerboard configuration such that adjacent pixels determine either the time of arrival or the number of electrons. This allows for correcting the time shift of the arrival time produced by the finite rise time of the circuit.

Certain embodiments of the present invention include the detection of the signal amplitude and the time of arrival at the detector in a "mixed" mode. It allows the reconstruction of the time of flight for each single ion that arrives at the detector pixel. Thereby the mass spectrometer realizes two aspects: A high spatial resolution, and a determination of the m/z ratio for one single ion that arrives at a single detector pixel. In addition, the time of flight mass spectrometer may be equipped with focusing electrostatic ion lenses such that the mass separator can be run under magnifying microscope conditions.

The recording time window of the ASIC detector and the fast readout of the detector array provide additional time savings in each measurement cycle and therefore increase sensitivity and/or speed. Especially, the noise suppression in each individual ASIC detector pixel is excellently suited to generate only data from events observed.

To acquire a m/z spectrum at a given location the ionization of the probe can be reduced such that multiple ionizations per pixel are avoided. In turn the image can be read out with the ASIC detector which allows the coverage of a large two dimensional area.

As an alternative to the TIMEPIX detector, e.g. the Gossip detector (V. M. Carballo et al.: The charge signal distribution of the gaseous micropattern detector gossip, RESMDD06 conference, Florence, Oct. 10, 2006, http://www.nikhef.n1/~i56/Hartjes_Gossip_10-10-06-1.ppt) or some other position sensitive detector allowing for time resolution may be used. Moreover the gossip detector has the advantage that each pixel may be configured to measure intensity and time simultaneously.

(4) Image Reconstruction

From the single individual measurements, a four-dimensional picture (two lateral dimensions [X,Y], one m/z dimension [m/z], and the number of events) may be reconstructed. The number of events corresponds to the abundance of an ion with that m/z ratio at the location [X,Y] on the surface of the sample.

A software algorithm may be programmed such that it allows first the determination of the precise arrival time and the intensity of the signal. Basically, a cluster analysis is performed that determines the position of the signal, the intensity of the signal, and its arrival time. Following to a cluster analysis, the reconstruction of a four dimensional image will be performed. It is based on the following construction principle: First all data generated are written in one virtual space of four dimensions (two lateral dimensions [X,Y], one m/z dimension [m/z] derived from the arrival time, and the number of events).

The method according to certain embodiments is suitable for a fast image acquisition in order to determine e.g. a tissue fingerprint rapidly and reliably. The intensities and different masses recorded in each spectrum are therefore focused on the most important ones. Several pictures can be taken of the same specimen in a short series of time and the detected ions are resolved according to their time of flight and relative location. In total a number of about 10 to 10.000 individual ions per pixel may be measured simultaneously. Subsequently, it is possible to reconstruct the spectrum of the whole sample. This will allow reconstructing the spectrum in varying depth and precision depending on the question asked.

Proof of Principle

The following experimental setup shows the proof of principle of certain embodiments.

Figure 9:
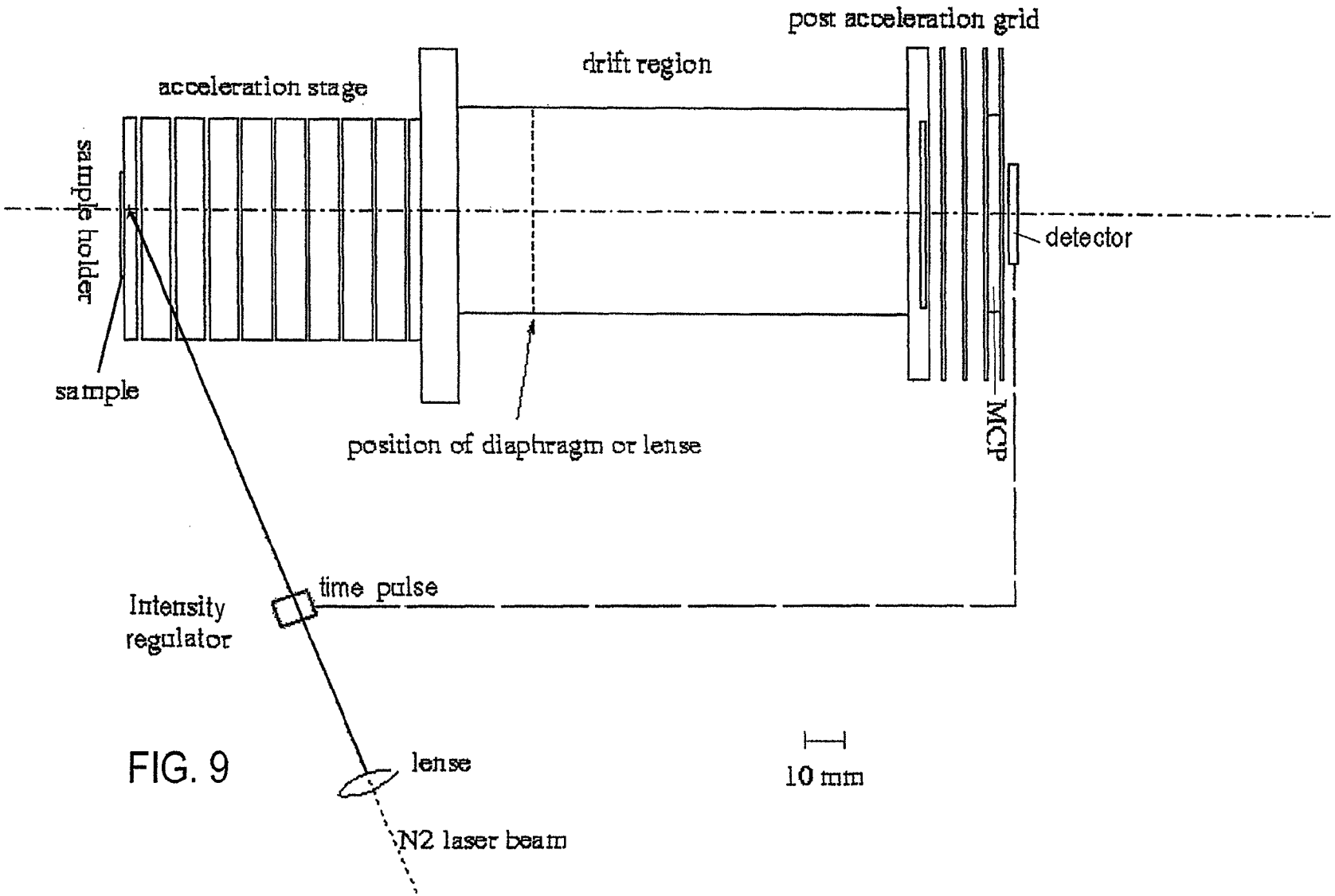
FIG. 9 shows another embodiment of the present invention.

A time of flight mass spectrometer as shown in FIG. 9 was used to proof the principle of the 2D mass spectrometer whereof an embodiment was described before. The mass spectrometer of FIG. 9 corresponds to that of FIG. 8 where the lenses and deflection elements are removed and the bending angle α is 0°. A diaphragm is inserted in the drift region. A light beam generated by a N2 LASER with about 20 μW/pulse output was used to ionize the calibration substance. The intensity of the LASER beam was regulated to optimize the ionization. Here, the laser generates also an electric pulse to determine the start time of the measurement. Within the time of flight tube, the sample is fixed on a sample plate at the beginning of the acceleration path. The time of flight instrument is under vacuum, typically $10^{-7}$ mbar.

Following the drift space, the post-acceleration, and the MCP the array detector are included in the vacuum chamber. The imaging mass spectrometer is connected to a FPGA based controller board which is interfaced to a PC.

Several different calibrants were used to proof the working principle of the detector.

Following a post-acceleration, ions hit the surface of a microchannel plate which amplifies the signal over several magnitudes. Typical amplifications of the signal can be achieved between $10^3$ and $10^7$.

Following the microchannel plate, the expelled electron cloud is detected by the two dimensional detector ASIC as described, which is positioned in a small distance from the microchannel plate, typically between 1.0 and 2.0 mm. This distance determines the diameter of the ion cloud that arrives at the ASIC detector. The detector localizes the arrival time of the electron cloud generated from different ions and their two dimensional distribution. Both, the time of Arrival, the intensity of the signal and the position are recorded at the same time. For that purpose, the pixelated area of the detector is subdivided in two principally different kinds of signal detection. One part of the detector records the arrival time of the signal whereas the second determines the signal intensity. Both types of detecting elements, the time resolving and the charge recording pixels, are arranged in a checkerboard fashion covering the sensitive surface of the detector chip. Distributions alternative to the checkerboard set up for the time and intensity resolving pixels are also possible.

To measure the Time of Arrival (ToA), a counter of each pixel arranged to record the time starts counting clock pulses when the pixel receives at least predetermined signal intensity. The counter is stopped at a fixed stop time relative to the start time. The stop time is determined such that all ions may reach the detector within this time. The number of counted clock pulses is thus a measure of the Time of Arrival, where earlier Times of Arrival correspond to larger number of counted clock pulses and vice versa.

Figure 2:
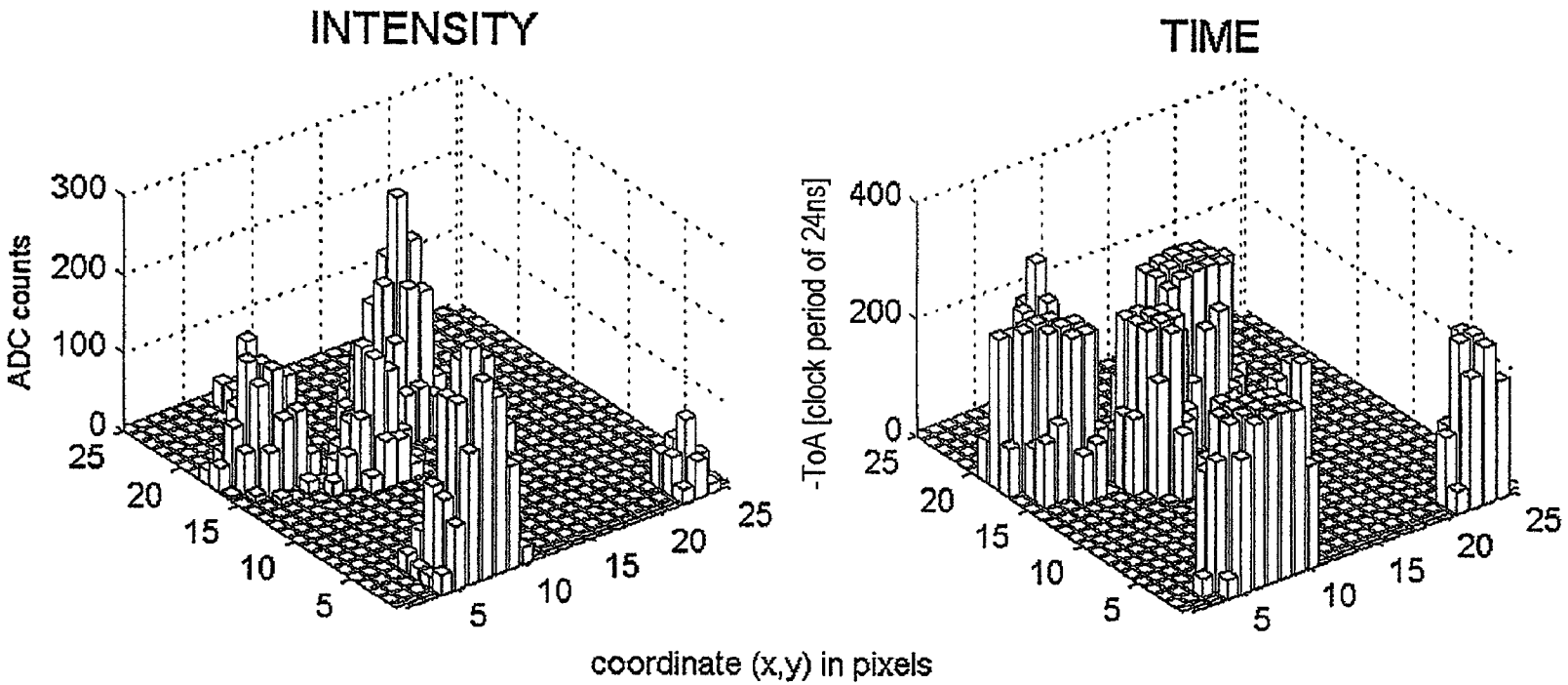
FIG. 2 shows signal intensities and Times of Arrival of a measurement performed with a Time of Flight imaging mass spectrometer according to the present invention.

The ASIC detector principle allows resolving the arrival time and the intensity of particles at the detector surface. A presentation resulting from a detector signal of a single measurement is shown in FIG. 2. In the left part of FIG. 2, the intensity of received electrons is shown in dependence of the position on the detector. In the right part, the simultaneously registered Time of Arrival is shown, also in dependence of the position on the detector.

Four different clusters can easily be distinguished whereof two clusters have a rather high intensity while the other ones have a medium and small intensity. The different intensity may be caused by impact of several ions at the same place or by different sensitivities of the MCP and/or the detector at different positions thereof. This last effect can be estimated from calibration measurements.

The Time of Arrival is evenly distributed within each cluster. In the present experiment, all ions are Fe+ ions, therefore all clusters have about the same time of arrival. Based on these data, a precise determination of the impact position and the Time of Arrival for each ion can be obtained.

Figure 3:
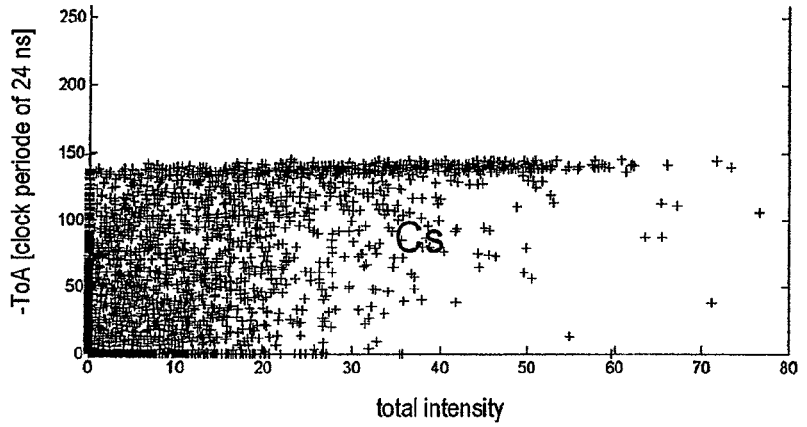
FIG. 3A shows the measured times of arrival in dependence of the measured total intensity in a measurement performed with a Time of Flight imaging mass spectrometer according to the present invention.
FIG. 3B shows the distribution of arrival times of the ions.
FIG. 3C shows a derived relation between time of flight and atomic number of ions.
Figure 3:
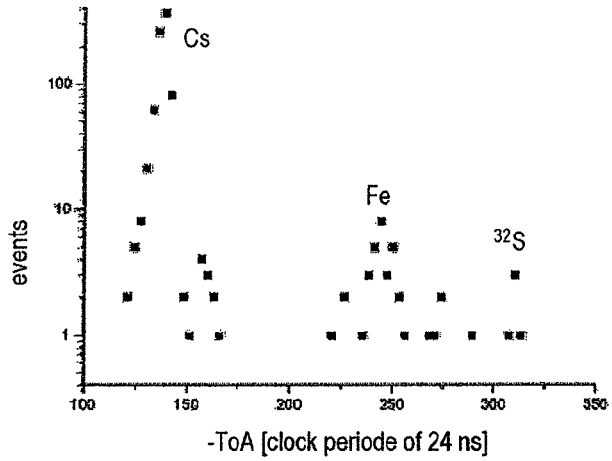
Figure 3:
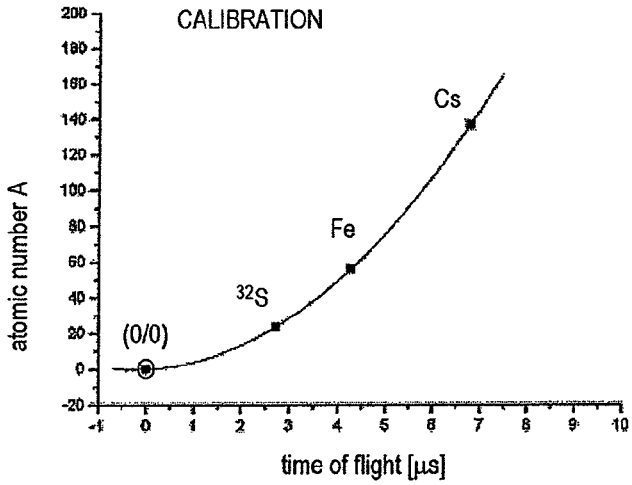

As calibration substance, CsI was ablated by MALDI from a sample plate. In FIG. 3A, the correlation between the arrival time versus the total intensity is plotted. Here, a negative ToA is shown, as larger values correspond to earlier times of arrival as explained above. Total intensity is the cumulated charge of the electrons triggered by an ion received by the detector. The scatter plot of the clusters detected indicates that a high number of clusters were generated around the expected arrival time for Cs+ ions. A second cluster is generated by iron ions and a third small cluster by sulphur ions, a by product of the ionization process from the metal plate holding the sample. This raw data analysis indicates that the arrival time of Cs+ ions is focussed indicating that the arrival time is mostly independent of the total intensity.

Closer inspection of the correlation plot for the Cs+ signal shows that the arrival time measured is not completely independent of the total intensity. A "walk" of the signal to earlier arrival times at higher total intensities was observed. This "time walk" is compensated for in a post acquisition data treatment.

At low rates of ions, the Time of Arrival may additionally be read out with even higher precision from the MCP. Then, the times measured by the MCP would be correlated with the times measured by the detector.

To gain insight in the dispersion of the arrival time measurements, the number of observed events versus the arrival time is plotted in FIG. 3B. The times were corrected for the dependency of the arrival time measurement from the total intensity of the signal. The figure indicates a precise measurement of the arrival time for Caesium ions, Iron ions and sulphur ions. The iron and sulphur ions were extracted from the sample holder.

The distribution of the arrival times of Cs+, Fe+, and $^{32}$S+ and the origin (0/0) were fitted by Gaussians and the positions produced a calibration curve as depicted in FIG. 3C.

Figure 4:
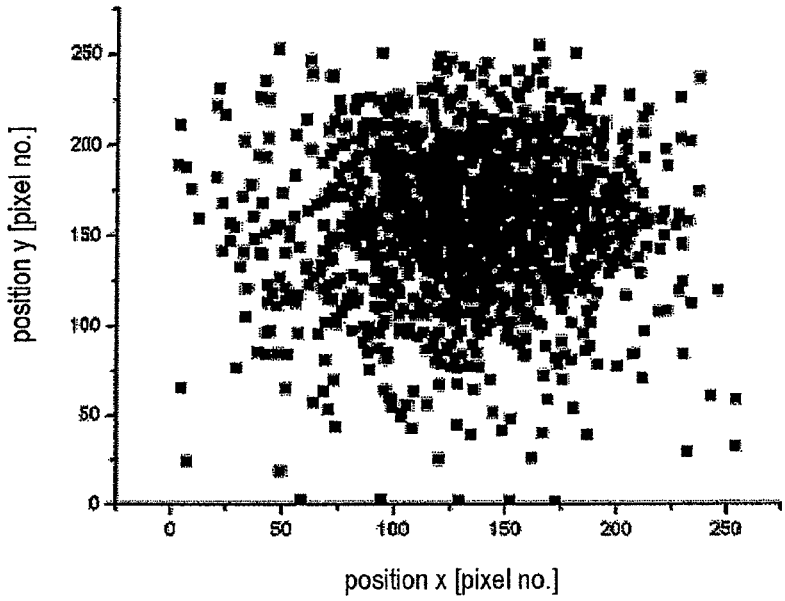
FIG. 4A shows the two-dimensional distribution of the impact of electrons on the detector in a measurement performed with an embodiment of the present invention.
FIG. 4B shows the detected intensity of each raw in dependence of the y-position in FIG. 4A.
Figure 4:
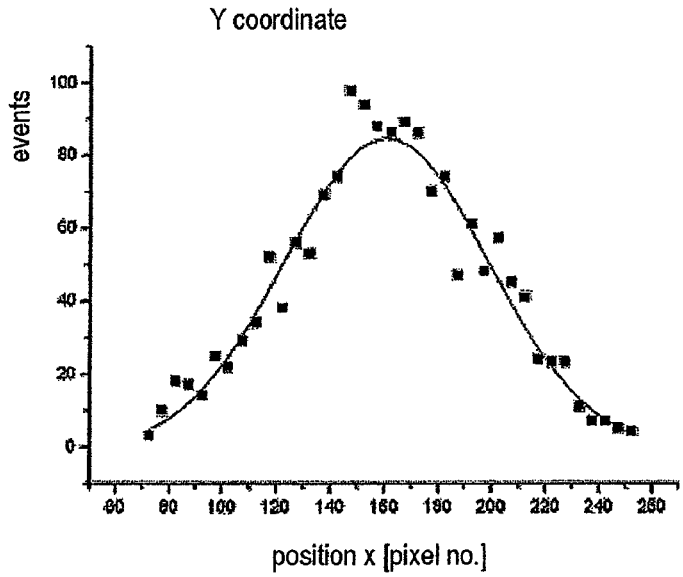

In a second set of experiments, to show the spatial resolution of the detector, the lateral dispersion of the ions generated at the target plate was determined. FIG. 4A depicts the distribution of single cluster events over the area of the array detector. In total 300 events were summed up. Since the laser spot has an extension of less than 0.5 mm, the distribution of the cluster positions visualizes the transversal component of the initial speed of the ions due to the ionization mechanism.

FIG. 4B displays a histogram of events measured across the y coordinate of the array detector. The events of one raw with same y-axis are summed. The dispersion of the Cs-ions at half width of signal height equals to 5 mm as estimated with a Gaussian curve fitted to the data.

Figure 5:
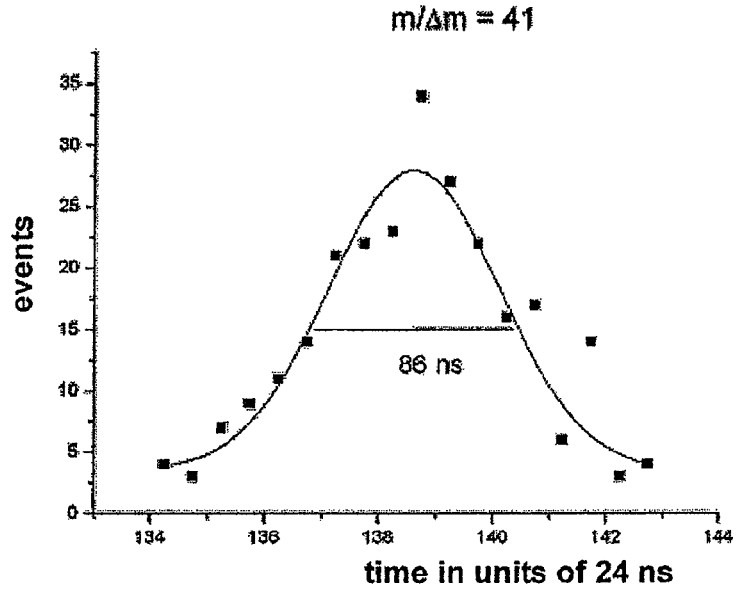
FIG. 5A shows the distribution of Times of arrival for measurements with Fe+ ions in an embodiment of the present invention.
FIG. 5B shows the distribution of Times of arrival for measurements with Cs+ ions in an embodiment of the present invention.
Figure 5:
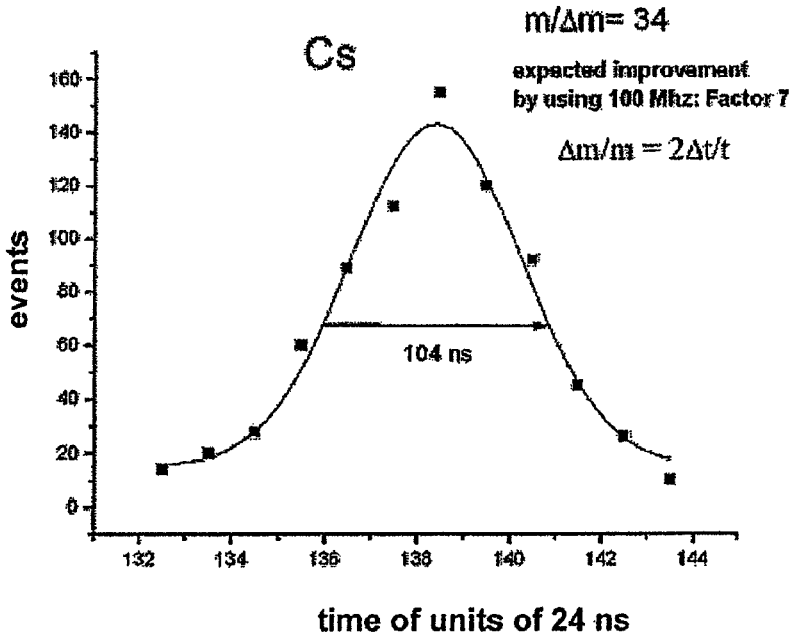

FIGS. 5A and 5B depict the dispersion in arrival time for the calibrant Fe+ (FIG. 5A) and Cs+ (FIG. 5B). The time resolution is limited by both, the clock cycle used for the array detector and the dispersion of the longitudinal component of the ion at the generation point. With this experimental setup, the mass resolution was determined to be 41 for the calibrant Fe+ and 34 for Cs+.

Figure 6:
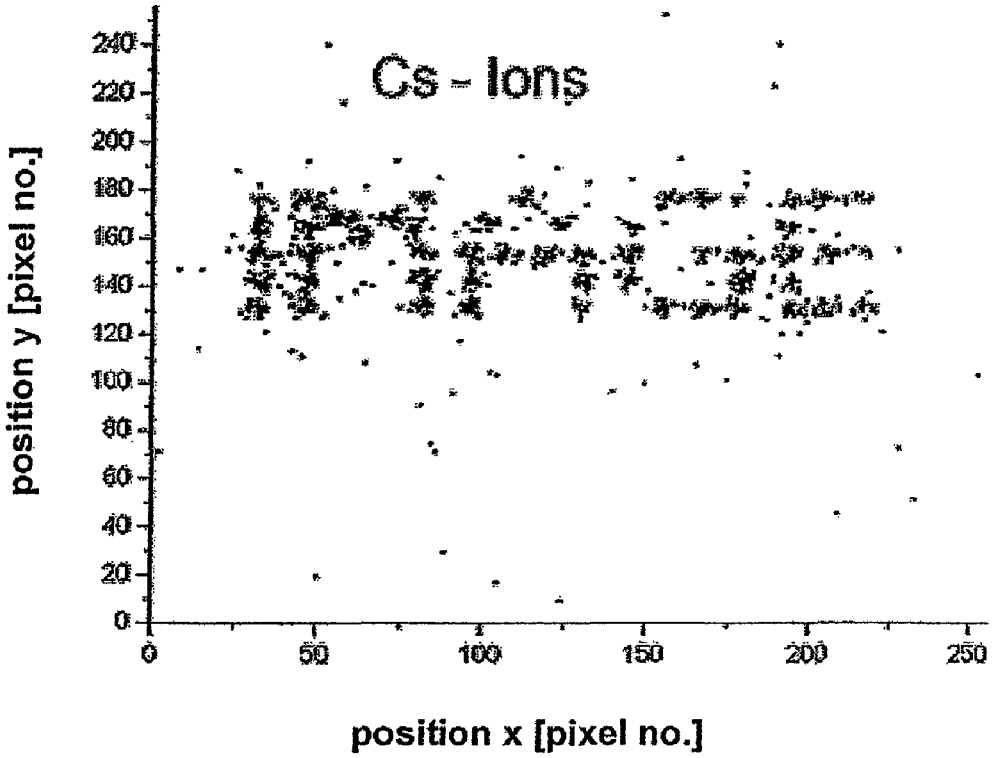
FIG. 6 shows impact positions in a measurement performed with an embodiment of the present invention.

FIG. 6 indicates the imaging capabilities of the novel array detector. A mask with holes depicting several different letters in a 5×5 matrix is shown. When introduced in the drift region 15 mm in front of the MCP, the holes are correctly displayed on the array detector. The example indicates the spatial resolution of the array detector, which is close to 300 μm corresponding to the size of the holes used for imaging.

Figure 7:
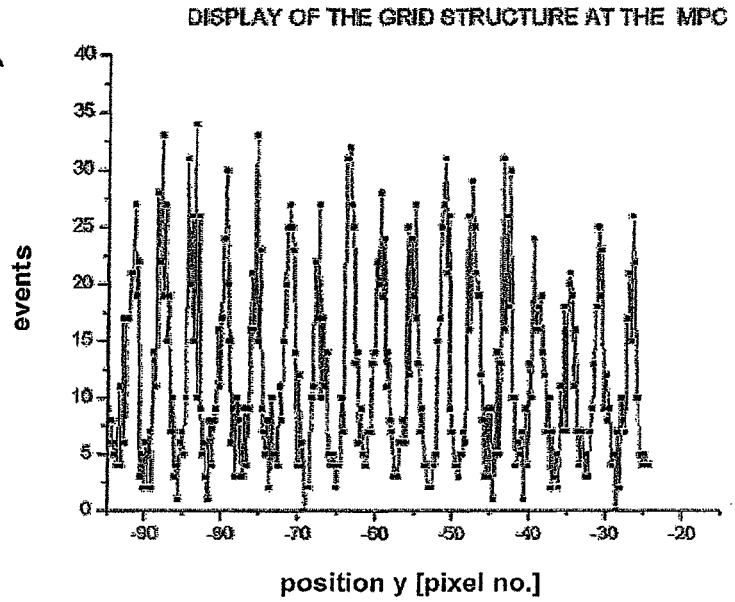
FIG. 7A shows impact positions in a measurement performed with an embodiment of the present invention.
FIG. 7B shows impact positions in a measurement performed with an embodiment of the present invention.
Figure 7:
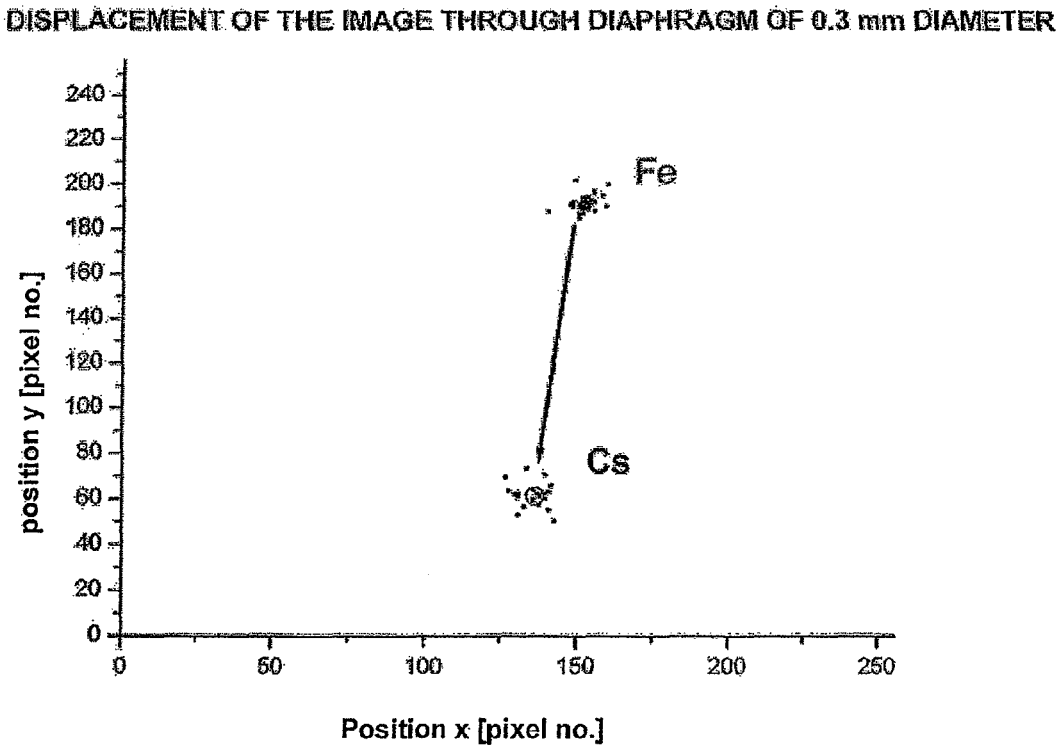

FIG. 7 shows another example of the image capability of the detector. The grid of the post-acceleration stage with a pitch of 0.22 mm is imaged onto the array detector resulting in a structure of about 40 μm resolution (estimated). Moreover the imaging capability of the whole apparatus is demonstrated in FIG. 7B where the laser spot (size<0.5 mm in both transverse dimensions) is directed to two spots on a sample separated by 7 mm, whereof one spot comprised Fe and the other spot comprised Cs. The ions are mapped through a pin hole of 0.3 mm diameter being positioned halfway between the sample and the MCP. The Fe− signal and the Cs− signal appear at different positions on the array detector according to the displacement of the laser spot by 7 mm. The lateral extension is a result of both the finite spot size of the laser and the size of the diaphragm.

APPLICABILITY

Images reconstructed from data acquired with mass spectrometers influence a wide range of different fields in research and applications. It has the potential to become a standard application in areas like material surface diagnostics and or diagnostics in medical care. In the following different fields of applications are described in which the imaging mass spectrometer disclosed here may be efficiently applied.

Material Surface Sciences

The imaging mass spectrometer disclosed here can be applied to the fields of material surface analysis being relevant for the imaging of the composition of surfaces. This improves the position sensitive diagnostics of deposited layers.

For example, during chip production, the surface of a chip is analyzed by imaging mass spectrometry in order to trace impurities during manufacturing.

Petrography and age dating through the isotopic distribution of the radioactive decay products can also be performed with the imaging mass spectrometer disclosed here. The imaging capability results in increase of sensitivity.

Biomedical Sciences

A technology based on mass spectrometric analysis of bio-molecules significantly impacts the understanding and cure of complex diseases like cancer. Indeed, mass spectrometric measurements allow the determination of the kind and number of bio-molecules, present in for example a cancer cell. This allows a distinction of these from adjacent cells. The mass spectrometer according to certain embodiments can be efficiently applied for high throughput mass spectrometric analyses. Therefore, it will have a major impact on how diagnostics of cancerous tissue will be performed in the future. Indeed, the application in imaging mass spectrometry in diagnostics allows for an unbiased identification of a tissue composition. When repeated measurements are performed and a large set of cell type specific bio-molecules are identified, a novel method to an analytic platform is set up that guides the discovery of new therapeutic interventions to complex diseases. For example, summing up all spectra obtained and all bio-molecules identified in a specific cell type allows reconstructing a bio-molecular profile or "molecular fingerprint" of this specific cell.

Molecular fingerprints can identify and characterize alterations and in cellular content like changed metabolic pathways in cancer cells or even distinguish normal and malignant cell types.

Mass spectrometers with imaging capabilities can visualize heterogeneous distributions of bio-molecules for example on a tissue section. On a tissue biopsy it can determine and spatially resolve the presence and location of aberrant cellular content, which can be a consequence of abnormal cell metabolism for example in cancer cells. Certain embodiments of the present invention may allow discriminating cells based on differences in their respective stereotyped molecular fingerprints fast and reliable. The imaging mass spectrometer according to certain embodiments can be applied to detect molecules in a tissue that are specific for one type of tissue only and thereby enable a distinction of two different kinds of tissue on the basis on the relative abundance and number of specific bio-molecules present in a sample. In contrast to traditional staining techniques utilized to differentiate between tumorigenic tissue and normal tissue, the development of an imaging mass spectrometer allows to determine in a relatively unbiased and fast way a number of different biomarker quantitatively and spatially. This is in large advantage to standard methods like for example immuno-histochemistry, a slow and rather inefficient method to stain tissue section for only one specific antigen. The fast processing of tissue section for imaging mass spectrometry makes this image acquisition an ideal technique to acquire and perform analytical routine inspections of biomedical samples. Due to its specific advantages the imaging mass spectrometric method according to certain embodiments allows to sample large datasets in a fraction of time in order to build a database of molecular fingerprints from different tissues. This biometric reference database can be accessed later in order to enable a fast an unrestricted identification of normal tissue cell, the origin of the cell and the origin of its tumour cells.

The present invention is not limited to the embodiments described, but variations and modifications may be made without departing from the scope of the invention as defined in the appended claims.

Described above are certain embodiments according to which a method of imaging mass spectroscopy and a corresponding apparatus are provided, wherein the m/z-ratio of ions as well as the location of said ions on a sample surface are detected simultaneously in a time of flight mass spectrometer. The detector is a semiconductor array detector comprising pixels, that each can be arranged to measure a signal intensity of a signal induced by the ions or their time of arrival. A four-dimensional image consisting of the two lateral dimensions on the sample surface, the m/z-ratio representing the ion type and the abundance of an ion type on the surface can be reconstructed from repeated measurements for which a correspondingly adapted computer program product can be involved.

The invention claimed is:

1. A method, comprising:

setting (S101) a start time;

extracting a first ion and a second ion (S102) from different locations on a sample by an ionization pulse at a fixed time relative to the start time;

accelerating (S103) said first and second ions towards a signal generator (MCP) located at a distance to the sample whereby the distribution of the first and second ions on the sample is isomorphously imaged to the signal generator (MCP), wherein the signal generator comprises a microchannel plate;

generating (S103), by the signal generator (MCP), a first signal from the first ion and a second signal from the second ion, wherein the first signal and the second signal have an amplification factor between $10^3$ and $10^7$ and are indicative of a position of an impingement of the first and second ions onto the signal generator, respectively;

detecting (S104), by a first detection element of a detector, if a part of said first signal with at least a first pre-defined intensity is received by said first detection element and, by a second detection element of the detector, if a part of said second signal with at least a second pre-defined intensity is received by said second detection element, wherein the first and the second detection elements are laterally separated pixels on the detector which is a semiconductor detector;

wherein the space, where the first and second ions travel towards the signal generator, the signal generator, and the detector are included in a vacuum chamber; wherein measuring (S104) and storing (S105), by the first detection element of the detector, a first time of arrival relative to the start time when said part of said first signal with at least the first pre-defined intensity is received by said first detection element, and measuring (S104) and storing (S105), by the second detection element of the detector, a second time of arrival relative to the start time when said part of said second signal with at least the second pre-defined intensity is received by said second detection element.

2. The method according to claim 1, wherein the extracting (S102) encompasses the extraction of a third ion (S102) from the sample by the ionization pulse;

the accelerating (S103) encompasses the acceleration of said third ion towards the signal generator (MCP), whereby the distribution of the first, second, and third ions on the sample is isomorphously imaged to the signal generator (MCP);

the generating (S103) encompasses the generation of a third signal from the third ion, by the signal generator (MCP), wherein the third signal has an amplification factor between $10^3$ and $10^7$ and is indicative of a position of an impingement of the third ion onto the signal generator;

the detecting (S104) encompasses the detection by a third detection element of the detector, if a part of said third signal with at least a third pre-defined intensity is received by said third detection element, wherein the third detection element is a pixel on the semiconductor detector; and wherein the method further comprises measuring, by the third detection element of the detector, an intensity of the received part of the third signal.

3. The method according to claim 1, wherein the ionization is performed by irradiation with a laser beam or with an ion beam that illuminates or impinges on the sample area homogenously.

4. The method according to claim 1, where the isomorphous imaging comprises a diminishment or an enlargement.

5. The method according to claim 1, further comprising ion trajectories between the sample and the signal generator that are straight, bend, in a closed loop, single or multiple time reflected before arrival to the signal generator.

6. The method according to claim 1, further comprising data processing methods during or after data acquisition that allow reconstructing a reconstructed position of the first and second signals from the positions of the first and second detection elements.

7. The method according to claim 2, wherein the extracting (S102) encompasses the extraction of a fourth ion from the sample by the ionization pulse, wherein the location of the fourth ion on the sample is different from that of the third ion;

the accelerating (S103) encompasses the acceleration of said fourth ion towards the signal generator (MCP), whereby the distribution of the first, second, third, and fourth ions on the sample is isomorphously imaged to the signal generator (MCP);

the generating (S103) encompasses the generation of a fourth signal from the fourth ion by the signal generator (MCP), wherein the fourth signal has an amplification factor between $10^3$ and $10^7$ and is indicative of a position of an impingement of the fourth ion onto the signal generator;

the detecting (S104) encompasses the detection by a fourth detection element of the detector, if a part of said fourth signal with at least a fourth pre-defined intensity is received by said fourth detection element, wherein the fourth detection element is a pixel on the semiconductor detector; and wherein the method further comprises measuring, by the fourth detection element of the detector, an intensity of the received part of the fourth signal; and data processing methods during or after data acquisition that allow reconstructing a reconstructed position of the third and fourth signals from the third and fourth intensities measured by the third and fourth detection elements.

8. The method according to claim 1, further comprising data processing methods during or after data acquisition that allow reconstructing a reconstructed time of arrival of the first and second signals from the first and second times of arrival measured and stored at the first and second detection elements.

9. An apparatus, comprising a sample holder;

time signal means for providing a signal pulse;

ionization means configured to ionize a first and a second atom or molecule from different locations of a sample on the sample holder by an ionization pulse at a fixed time relative to the signal pulse, thus obtaining a first ion and a second ion;

imaging means configured to extract the first and second ions from the sample and to accelerate them towards a generation means, whereby the distribution of the first and second ions on the sample is isomorphously imaged to the generation means (MCP), wherein the generation means (MCP) comprises a microchannel plate and is configured to generate a first signal from the impinging first ion and a second signal from the impinging second ion, wherein the first signal and the second signal have an amplification factor between $10^3$ and $10^7$ and are indicative of a position of an impingement of the first and second ions onto the generation means (MCP), respectively;

a semiconductor detector comprising a first and a second detection element, wherein the first detection element is configurable to detect if a part of said first signal with at least a first predefined intensity is received by said first detection element, the second detection element is configurable to detect if a part of said second signal with at least a second predefined intensity is received by said second detection element, and the first and the second detection elements are laterally separated pixels on the detector;

wherein a space, where the first and second ions travel towards the generation means, the generation means, and the detector are included in a vacuum chamber; wherein the first detection element is configurable to measure and store a first time of arrival relative to the start time when said part of the first signal with at least the first predefined intensity is received by said first detection element, and the second detection element is configurable to measure and store a second time of arrival relative to the start time when said part of the second signal with at least the second pre-defined intensity is received by said second detection element.

10. The apparatus according to claim 9, wherein the ionization means is further configured to ionize a third atom or molecule of the sample by the ionization pulse, thus obtaining a third ion;

the imaging means is further configured to extract the third ion from the sample and to accelerate it towards the generation means, whereby the distribution of the first, second, and third ions on the sample is isomorphously imaged to the generation means (MCP), wherein the generation means is configured to generate a third signal the impinging third ion, wherein the third signal has an amplification factor between 103 and 107 and is indicative of a position of an impingement of the third ion onto the generation means (MCP);

the detector comprises a third detection element configurable to detect if a part of said third signal with at least a third predefined intensity is received by said third detection element, and the third detection element is a pixel on the detector configured to measure a third intensity of the received part of the third signal.

11. The apparatus of claim 10, wherein the third detection element configurable to measure an intensity of said part of the signal is further configurable to measure a third time of arrival of the received part of the third signal, or wherein the first and second detection elements of the detector are configurable to measure a first and second intensity of the received parts of the first and second signals, respectively.

12. The apparatus according to claim 9, wherein the first and second detection elements of the detector are configurable to measure a first and second intensity of the received parts of the first and second signals, respectively.

13. The apparatus according to claim 11, further comprising storage means configured to store the first and second times of arrival, the measured first and second intensities, and a first and second identifiers for the first and second detection elements, respectively, as a data set;

time reconstruction means configured for reconstructing an averaged time of arrival from the stored times of arrival of the parts of the signal; and, position reconstruction means configured for reconstructing an average position of the input of the first and second signals from the measured intensities and the identifiers.

14. The apparatus according to claim 10, wherein the detector comprises a self-repetitive mosaic of detection elements spatially arranged in a repeating pattern such that detection elements including the first and second detection elements configured to measure a respective time of arrival alternate according to a predefined rule with detection elements including the third detection element configured to measure a respective intensity, wherein the detection elements are pixels.

15. The apparatus according to claim 10, where the third signal comprises electrons generated by a micro channel plate and the third intensity corresponds to the number of electrons impinging the third detection element.

16. The apparatus according to claim 9, further comprising a second detector with detection elements, wherein the second detector is a semiconductor detector and the detection elements on the second detector are pixels, where the detector and the second detector are located adjacent to each other in the same plane, and where a pitch between adjacent detection elements on the detector and a pitch between adjacent detection elements on the second detector are substantially the same as a pitch between a detection element on the detector and an adjacent detection element on the second detector.

17. Computer program product embodied on a computer-readable medium, comprising program instructions the execution of which result in operations of the method according to claim 5 when said program product is run on a computer.

18. The computer program product according to claim 17, further comprising program instructions which perform, when run on a computer evaluating the number of signals with substantially the same lateral position and the same time of arrival when performing the method of claim 5, and storing the evaluated number, the lateral position and the time of arrival in a set of data.

19. The apparatus according to claim 9, where each of the detection elements of the detector has a multi-hit capability.

* * * * *